US005222337A

United States Patent [19]

Thomsen et al.

[11] Patent Number: 5,222,337

[45] Date of Patent: Jun. 29, 1993

[54] INSULATION OF FLAT ROOFS AND SIMULTANEOUS CONSTRUCTION OF A GRADIENT FOR POSITIVE DRAINAGE OF THE ROOFING PLACED ON THE INSULATION

[75] Inventors: Bo Thomsen, Tåstrup; Henning Nielsen, Holte, both of Denmark

[73] Assignee: Rockwool International A/S, Hedehusene, Denmark

[21] Appl. No.: 668,506

[22] PCT Filed: Sep. 25, 1986

[86] PCT No.: PCT/DK89/00223

§ 371 Date: Mar. 26, 1991

§ 102(e) Date: Mar. 26, 1991

[87] PCT Pub. No.: WO90/03482

PCT Pub. Date: Apr. 5, 1990

[30] Foreign Application Priority Data

Sep. 26. 1988 [DK] Denmark ..... 5327/88
Nov. 14. 1988 [DK] Denmark ..... 6346/88

[51] Int. Cl.[5] ..... E04D 13/16

[52] U.S. Cl. ..... 52/404; 52/13; 52/DIG. 10

[58] Field of Search ..... 52/11, 13, 15, 90, 198, 52/199, 302, 303, 309.8, 408

[56] References Cited

U.S. PATENT DOCUMENTS

| | | | |
|---|---|---|---|
| 2,379,051 | 6/1945 | Wallace . | |
| 3,601,936 | 8/1971 | Schmidt | 52/14 |
| 4,503,644 | 3/1985 | Coutu, Sr. | 52/13 |
| 4,642,950 | 2/1987 | Kelly | 52/90 |
| 4,719,723 | 1/1988 | Van Wagoner | 52/15 |

FOREIGN PATENT DOCUMENTS 2745845 4/1979 Fed. Rep. of Germany .

215825 10/1967 Sweden .

*Primary Examiner*—Carl D. Friedman
*Assistant Examiner*—Matthew E. Leno
*Attorney, Agent, or Firm*—Watson, Cole, Grindle & Watson

[57] ABSTRACT

Insulation of flat roofs and simultaneous construction of a gradient for positive drainage of the roofing placed on the insulation, said gradient being perpendicular to the outer edges of the roof and running in two directions perpendicularly to one another, and where between the differently angled falls border lines are running from the corners of the roof towards the center line of the roof, said insulation comprising rectangular elements having an oblique surface corresponding to the gradient of the roof. In order to provide a roof insulation, by means of which and by use of only a few standardized element san insulation layer with a gradient may be obtained without any cutting during the laying out, said gradient either running from the middle of the roof and towards its edge or the other way round from the edge of the roof towards the middle to a drain, the insulation is characteristic in that the rectangular elements are arranged in rows parallel to the edges of the roofs in such a way that at the border lines where the lengths running perpendicular to one another meet, one of these rows adjoins these border lines with one of the highest corners of the elements, elements being arranged in another row running parallel to the first row, and that along the border line a number of rectangular, triangular adjusting elements are arranged in a jagged pattern on top of the elements, the hypotenuse of which runs along the border line and the two other sides of which are made of side faces in the shape of an acute triangle, the side edge opposite the acute angle having a length, which corresponds to the difference in thickness between the thicker and the thinner part of the rectangular element.

5 Claims, 2 Drawing Sheets

INSULATION OF FLAT ROOFS AND SIMULTANEOUS CONSTRUCTION OF A GRADIENT FOR POSITIVE DRAINAGE OF THE ROOFING PLACED ON THE INSULATION

BACKGROUND AND SUMMARY OF THE INVENTION

The present invention relates to insulation of flat roofs and simultaneous construction of a gradient for positive drainage of the roofing placed on the insulation, the gradient being perpendicular to the outer edges of the roof and running in at least two directions perpendicularly to one another, and having between the differently angled gradients intersection lines comprising lines running from the corners of the roof towards the centre line of the roof, the insulation comprising rectangular elements arranged in rows parallel with the edges of the roof, each element having a sloping surface corresponding to the gradient of the roof and a greater thickness at two of the corners than at the two diametrically opposite corners, and adjusting elements of pyramidal shape arranged on top of the rectangular elements along the intersection lines, which pyramidal adjusting elements comprise two right-angled triangular side faces, the hypotenuse of which runs along the intersection line and and two other faces, which are narrow, acute triangles.

From U.S. Pat. No. 4,503,644 an arrangement and a system for creating a sloping roof out of a flat roof is known. Such an arrangement is often used on buildings which were originally constructed with a completely flat roof, and where in the centre of the roofing a drain for water was placed, the outlet being in the interior of the building. In connection with roof repairs, an insulation layer of slabs is placed on top of the original roofing, which slabs have not only been cut in such a way that they can cover the roofing area, but which are also cut in the shape of a wedge, making it possible to give the insulation, after it has been laid out, an even gradient towards the drain. In order to provide a uniform gradient, in which the intersection lines run from the corners of the roofing drain, an individual cutting of an essential part of the slabs forming the insulation layer is required. The individual cutting is costly, both in connection with the cutting process as well as during the placing, where it is necessary to make sure that the slabs are placed correctly and not mixed up. If one or more of the slabs are damaged during transport or during the placing, it will be complicated to get a replacement slab.

On account of the stricter rules recently introduced for work in connection with the laying out of insulation materials containing synthetic mineral fibres, the insulation materials should be of the kind not requiring adjustment at the site, where they are placed, or such an adjustment should at least be reduced to a minimum. These rules prevent any manual shaping or adjustment of standardized elements at the work site, as it is required in practice that the normal shaping should take place under controlled, industrial conditions, where effective precautions against undesirable dust can be taken.

It is the object of the present invention to provide a roof insulation where by means of a number of standardized elements an insulation layer with a gradient can be constructed without any cutting during the placing, the gradient running either from the centre of the roof against the edge or the other way round from the edge of the roof towards the centre to a drain. The number of different elements should be small, and the placing should be possible according to a simple and foreseeable system in order to avoid cutting of elements at the building site, but it should also be possible to replace damaged elements by adjusting standardized elements through simple shortening at right angles without any waste and without the use of dust-producing mechanical tools.

The object of the invention is met by means of an insulation, which is characteristic by the subject matter of the characterizing clause of claim 1. In addition to one or maybe two sets of rectangular elements, which can be put together for the formation of a gradient, only one special, triangular adjusting element will be needed for the formation of even roofing areas around the border lines between the roofing areas, and, if necessary, a plane infilling element to be place don top of the rectangular elements. There is in particular no need for cutting the rectangular elements along oblique lines and only a slight need for preceding marking of the elements. Thereby a great flexibility is ensured during the carrying out of the insulation work at the building site.

The simplest form of insulation is achieved according to a preferred embodiment of the invention when the rows in the two directions running perpendicularly to each other have the same width, and when the adjusting elements are in the shape of an isosceles triangle. According to this embodiment the border lines will run under an angle of 45° in relation to the edges of the roof, which, when it is a question of rectangular buildings, often result sin a ridge or a valley in the middle of the roof. It is, however, possible also to use the insulation in connection with roofs whose gradient differs in the two directions running perpendicularly to each other. It is in particular advantageous to distribute the gradient of the rows in one of the directions on two sets of rectangular elements having the same dimensions as the elements in the rows running perpendicularly thereto, and also that the adjusting elements are isosceles triangles, the two sides of which are twice as long as the third one.

BRIEF DESCRIPTION OF THE DRAWINGS

The invention will be described in detail with reference to the accompanying drawing, in which.

DETAILED DESCRIPTION OF THE PREFERRED EMBODIMENT

Figure 1:
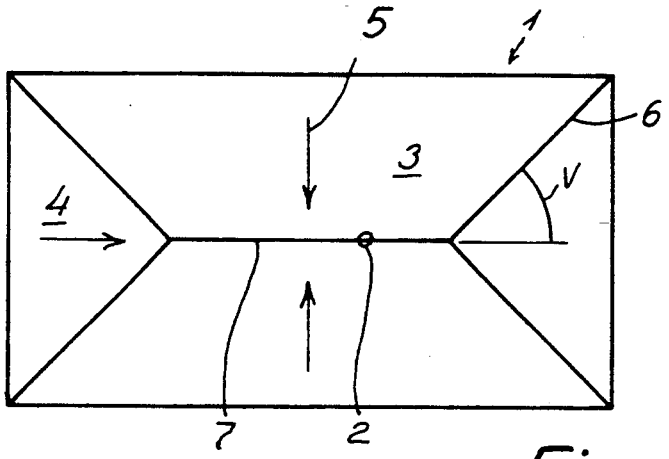
FIG. 1 shows a building with a roof having an envelope gradient seen from above.

FIG. 1 shows a building seen from above with a roofing 1. The roofing can be found on an existing building which has been constructed with a plane and flat roof and where a new roof is desired, the roof having a gradient towards a drain 2 placed centrally on the roof for collecting water falling on the roof. Simultaneously with the establishing of the new roof with a gradient, it is desired to improve the thermal insulation of the roofing. The roof may, however also be on a new building, where the bearing construction forms a plane supporting surface, on which the roofing and at least a part of the thermal insulation of the roof is to be placed. Also in this case it is desired to drain off water through a drain placed centrally. In such cases the so-called envelope gradient is used, according to which the roof is divided into surface sections 3,4 having a gradient from the outer edge of the roofing towards the centre thereof as indicated by the arrows 5. These surfaces adjoin at border lines 6 and at a valley line 7 found in rectangular buildings. If the same gradient is sued for the surfaces sections 3 and 4, the border lines will form an angle V of 45° to the outer dimensions of the building, and this is a prerequisite for the roof insulation according to the invention described in the following. However ,the invention can be modified in such a way that it can also be used in connection with different gradients in the directions running perpendicularly to each other. It is in particular advantageous if the magnitude of the gradients in the two directions are multiples of each other.

Figure 2:
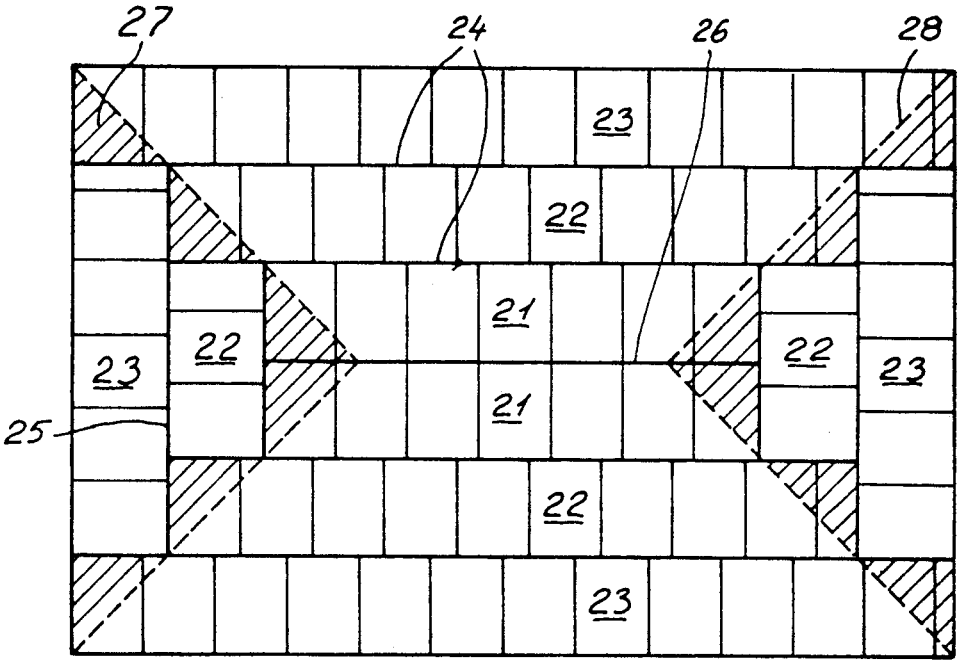
FIG. 2 shows the placing on the roof of insulation elements according to the invention.

In the roof insulation according to the invention rectangular, wedge-shaped insulation sheets 21,22,23 are used, these sheets being laid out as shown in FIG. 2. The wedge-shape of the insulation sheets is adjusted in such a way that when the sheets are placed on a plane, horizontal surface, the desired gradient is obtained, and the sheets have such a difference in thickness that the thickness of the highest side face of the sheets 21 is exactly equal to the thickness of the sheets 22 at their lowest side face. The same applies to the sheets 22 and 23. In connection with larger roof areas, an even thicker insulation sheet may be required, or a plane-parallel element may be placed under a sheet of type 21 and having a thickness corresponding to the total wedge-shape of the three elements. The thickest insulation sheets 23 are placed in a row along the longest side faces of the roofing and all along to the short side faces. The rows of insulation sheets are placed with the thinnest side face towards the middle of the roof, thus forming a line 24. Then a row of insulation sheets in placed along the short side faces of the roofing between the lines 24, the thinnest side faces facing inwards towards the middle of the roofing also in this case. The thinnest side faces then form a line 25. Then a further row of insulation sheets 22 is placed between the lines 25 and along the lines 24, etc., until the whole roofing area is covered. If the roofing area is not of a size corresponding exactly to a multiple of the size of the insulation sheets, one of the sheets at the ends of the rows is cut, and the sheets 21 are cut at the middle of the roof in the line 27, along which the sheets adjoin. In this way a roofing with a correct gradient towards the middle of the roof is achieved, apart from the hatched areas 27 limited by the future border lines 28 between the division areas of the roof and a saw-tooth-shaped contour between the rows of insulation sheets standing perpendicularly to one another.

Figure 3:
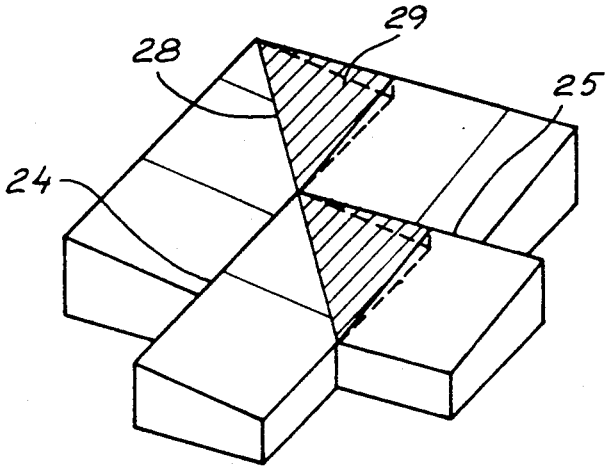
FIG. 3 shows a section of the roof according to FIG. 2 in an oblique depiction.

FIG. 3 shows in oblique depiction a roofing area along one of the border lines 28. It will be seen how the rows of elements 21,22, and 23 form triangular areas (hatched) in which the gradient of the roofing is not correct. According to the invention the false gradient is set off by means of a triangular element 29 glued on top of the roof sheets 23 in exactly the hatched areas. The triangular element is in the shape of an isosceles triangle with a thickness at its right-angled vertex corresponding to the difference in thickness of the insulation sheets at their thickest side face and their thinnest side face. The triangular adjusting element has a sharp edge at its hypotenuse. The element 29 is placed with its hypotenuse along the border line 28.

Figure 4:
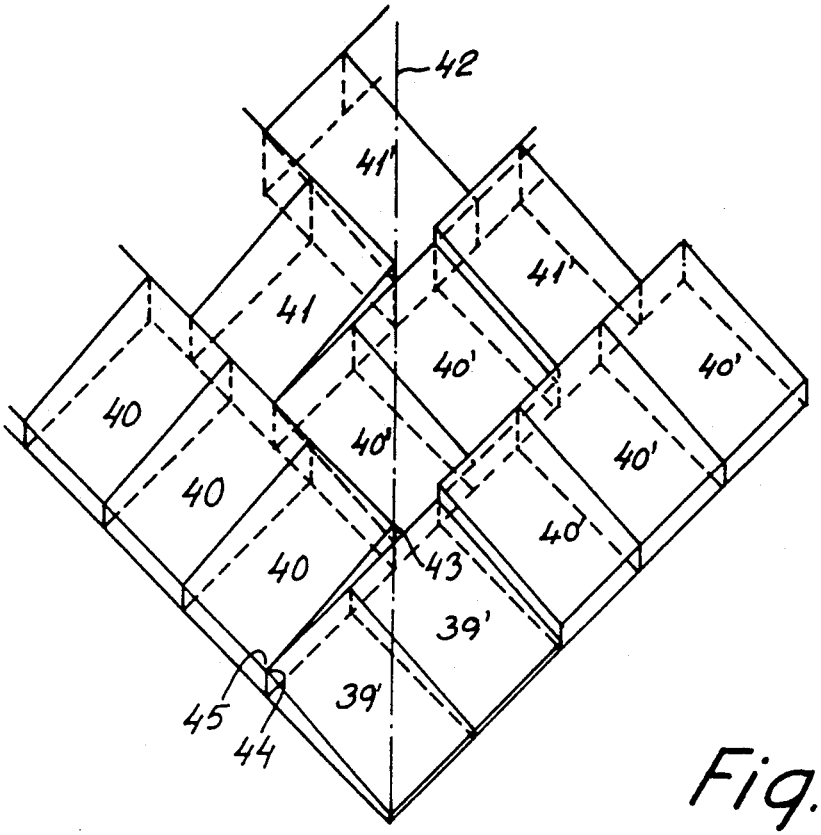
FIG. 4 shows in oblique depiction a corner of a roof with a gradient form the middle towards its edges after the placing of the rectangular elements and before the placing of the adjusting and infilling elements.

The insulation according to the invention may, however, also be used for the building up of a gradient running from the middle of the roof towards its edges. FIG. 4 shows a corner of such a roof, where from the corner of the roof a border line between two adjacent roofing areas is to run, a so-called hip, towards the ridge of the roof. According to the invention rows of rectangular elements 40,40' are placed along the edges of the roof with an oblique surface corresponding to the gradient of the roof. The row of elements 40 is placed in such a way that it adjoins the border line with one of its highest corners 43, while the row running perpendicularly thereto and containing the elements 40' is filled out with elements to the corner of the roof. The elements 39', which are closest to the corner, should be so much thinner than the remaining ones of the row that they at their highest corner 44 have exactly the same height as the lowest corner 45 of the element 40. Then the rows 41,41' are placed and a pair of somewhat thinner elements called 40' are placed at the end of the row, because they are identical with the elements 40' in the outer row. This continues until the roof is covered by elements and until around the border line 42 a number of relatively displaced areas with a slightly smaller thickness than the remaining roofing is created.

Figure 5:
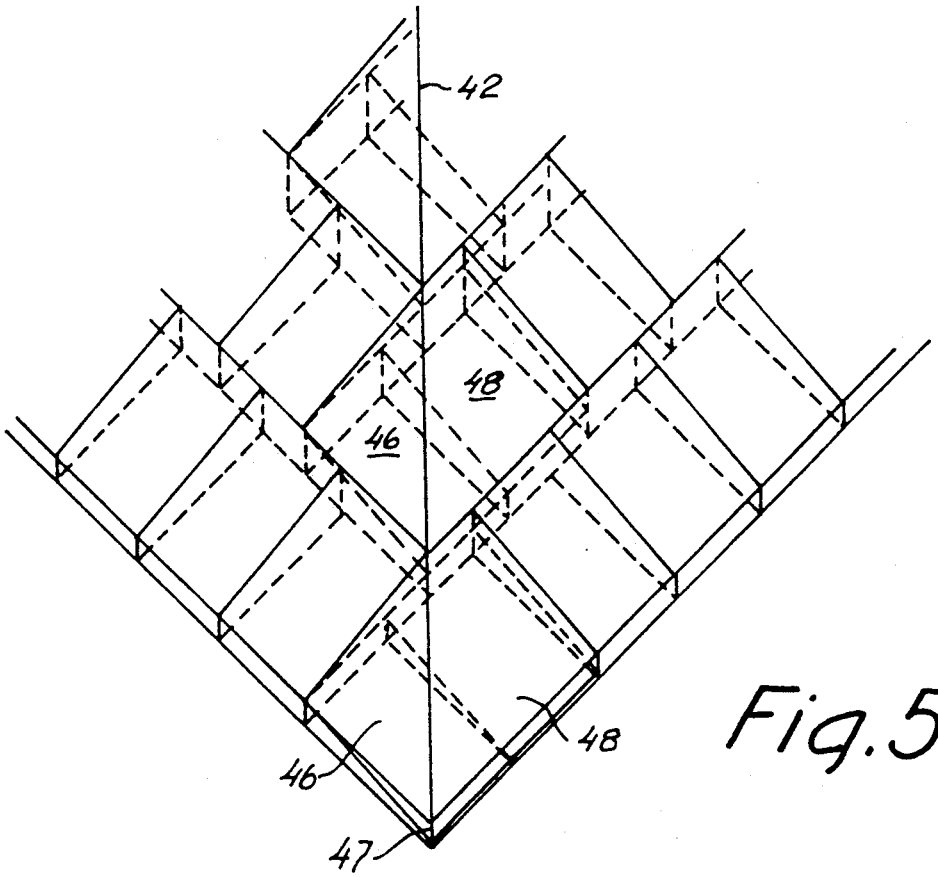
FIG. 5 shows in a depiction corresponding to FIG. 4 a corner of a roof after the adjusting and infilling elements have been placed.

The insulation is finished by placing an adjusting triangle 46 in the somewhat thinner areas as shown in FIG. 5. The adjusting triangle is right-angled and its side faces running along the two sides of the triangle are isosceles triangles, the side face 47 opposite the acute angle having a length corresponding exactly to the difference in thickness between the two end faces of the rectangular elements 39', 40 and 41. The rest of the area is filled out with a trapezoidal infilling element 48 with uniform thickness corresponding to the length of the side face 47. The trapezoidal element 48 and the hypotenuse of the triangular adjusting element 47 adjoin along the border line 42. In the most preferred embodiment the elements 40 and 40' will be identical, the adjusting triangle 46 becoming an isosceles triangle and the border line running under an angle of 45° to the edges of the roof. By means of a pair of wedge-shaped, rectangular elements and a triangular adjusting element as well as a trapezoidal infilling element, it is thus possible to place an insulation creating a gradient from the middle of a plane roof towards its edges. All elements are of standard-size apart from a few of the elements, which have to be shortened to comply with the size of the roof.

The insulation sheets are preferably made from mineral wool having such a rigidity and strength that they can withstand the loads normally occurring on a roof. The sheets 21,22, and 23 may for example be produced from strips put on edge of a relatively hard and rigid mineral wool with a specific weight of $80/m^3$, this value being variable within relatively wide frames according to the type of fibres and the amount and type of binder used for glueing the fibres at their intersection points. The wedge-shape of the insulation sheet is obtained by making the strips wedge-shaped. The strips are put together and glued with a surface on top which can resist a person's walking thereon. Preferably also this sheet is made from mineral wool, which is essentially inorganic and therefore resistant towards rot and fire, but the traffic-proof surface may also consist of other materials, such as wood fibre sheets, wood wool cement and the like. A suitable material is a mineral wool sheet with a specific weight of 198 kg/m$^3$ and a relatively high content of binder of 3–5%. The surface sheet and the lamina may be glued together with a suitable binder, for example asphalt. The same material as the one used for the surface sheet may be used for the adjusting triangles, the result being a uniform protection against traffic all over. After the placing of the adjusting triangles and the glueing with a suitable binder, for example a cold-flowing asphalt binder or hot asphalt, or a binder on another base, the insulation layer is covered by a suitable roofing, for instance roofing felt, a foil of synthetic rubber or any other corresponding roof covering, which is suitable for roofs having a gradient of a few percent.

The embodiment described above, which is the most advantageous embodiment of the invention, entails that the angle V is 45°, which in case of buildings which are essentially longer than broad is not always advantageous. It is in such cases possible to distribute the gradient of the elements in one of the directions perpendicular to each other to two rows of elements. This entails that the adjusting triangles will no longer be isosceles triangles, but right-angled triangles, the one side of which is twice as long as the other. The advantage of building the roof from few standardized elements is still there, and the normal adaptation at the building site is minimal, unless some of the elements have been damaged during transport or during the laying out, in which case adjustment of an extra standard-element will not present any problem, as it will only be a question of a perpendicular shortening.

Normally, it is preferred to let all rows in one direction adjoining the border lines with one of the highest corners. It may, however, in order to avoid cutting of the elements at the building site, the piece cut off having in most cases to be discarded, in certain cases be advantageous to lay out the rows in such a way that the rows at the one end adjoin the border lines with one of the highest corners and at the other end with one of the low corners. This has no influence on the adjusting triangles, which also in this case will have the same shape as the gradient of the wedge-shaped elements.

We claim:

1. In combination with a flat roof that defines straight outer edges, outer corners and a centre line, a roofing layer positioned on said flat roof for insulation and for providing a gradient for positive drainage, said gradient being perpendicular to the outer edges of the roof and running in at least two directions perpendicularly to one another, and having between the differently angled gradients intersection lines that extend from the outer corners of the roof towards the centre line of the roof, said roofing layer comprising rectangular elements arranged in rows parallel with the outer edges of the roof, each rectangular element having a sloping upper surface corresponding to the gradient of the roof and a greater thickness at two corners thereof than at opposite corners thereof, and adjusting elements of pyramidal shape arranged on top of the rectangular elements along the intersection lines, said pyramidal adjusting elements each comprising two right-angled triangular side faces, the hypotenuse of which runs along the intersection line and two other faces which are narrow, acute triangles, wherein at the intersection line the rows of rectangular elements, while retaining their rectangular shape, adjoin the intersection line having a corner with the greater thickness, and the rectangular elements in the rows running perpendicularly thereto adjoin the intersection line having the a corner with less thickness, and that along the intersection line a number of said pyramidal adjusting elements are arranged in a jagged pattern on top of the rectangular elements in the areas that are lower than the intended upper face of the roof, a shortest edge of the narrow triangular side faces corresponding the the difference in thickness between the greater thickness and the lesser thickness of the rectangular element.

2. The combination according to claim 1, wherein the rows of rectangular elements running perpendicularly to each other have the same width and that the right-angled side faces of the adjusting elements are in the shape of an isosceles right-angled triangle.

3. The combination according to claim 1, wherein the gradient of the roof in the rows in one of the directions is distributed on two paris of rectangular elements having the same dimensions in a plane of the roof as the elements of the rows running perpendicularly thereof, and that the adjusting elements are in the shape of rectangular triangles, a first side of which is twice as long as a second side.

4. The combination according to claim 1, wherein the gradient of the roof extends from the outer edge of the roof towards the centre or centre line of the roof, wherein each of the other rows adjoins the first rows with a side face against the thinner edge of the first row, and in that the adjusting elements are in the form of tetrahedrons having a sharp edge along the hypotenuse of the right-angled side faces and wherein a biggest thickness thereof at the right-angled corner.

5. The combination according to claim 1, wherein the gradient of the roof extends from the centre of the roof towards its outer edge, wherein at the intersection lines the rectangular elements, which adjoin the intersection lines with the thinner corner or are crossed by the intersection line, are reduced in thickness by the difference between the thickness of the opposite corners with respect to the other rectangular elements in the same row, but have the same slope, wherein each said adjusting element is a four-sided pyramid having a top at the rectangular corner of the right-angled side faces and a base along the hypotenuse, a width of the base corresponding to the difference in thickness between the thicker and thinner part of each rectangular element, and including supplementary adjusting elements having a uniform thickness corresponding to said width of the base of the pyramidal adjusting elements which are placed on the remainder of the elements.

* * * * *